United States Patent [19]

Berg

[11] Patent Number: 4,949,474

[45] Date of Patent: Aug. 21, 1990

[54] METHOD AND APPARATUS FOR DRYING PARTICULATE MATERIAL

[75] Inventor: Eero Berg, Oulu, Finland

[73] Assignee: A. Ahlstrom Corporation, Karhula, Finland

[21] Appl. No.: 432,866

[22] Filed: Nov. 7, 1989

Related U.S. Application Data

[63] Continuation-in-part of Ser. No. 207,865, Jun. 17, 1988, abandoned.

[30] Foreign Application Priority Data

Jun. 17, 1987 [FI] Finland ..... 872695

[51] Int. Cl.[5] ..... F26B 25/00

[52] U.S. Cl. ..... 34/102; 34/236; 34/11

[58] Field of Search ..... 34/10, 11, 179, 216, 34/181, 217, 236, 102, 57 R, 57 D, 57 C

[56] References Cited

U.S. PATENT DOCUMENTS 605,025 5/1898 Spencer ..... 34/102
2,412,763 12/1946 Baker ..... 34/11
3,161,485 12/1964 Buhrer ..... 34/236

FOREIGN PATENT DOCUMENTS 61489 10/1943 Denmark .
1290094 2/1969 Fed. Rep. of Germany .
1604759 12/1970 Fed. Rep. of Germany .
66485 12/1984 Finland .
61996 1/1940 Norway .

*Primary Examiner*—Henry A. Bennet
*Assistant Examiner*—John Sollecito
*Attorney, Agent, or Firm*—Nixon & Vanderhye

[57] ABSTRACT

A method and apparatus for drying particulate material such as bark by forming a circulating bed of other material to be dried, which bed, being guided by wires, moves on an endless web around two wire turning rolls. Material to be dried is continuously fed onto the bed and dried material is continuously discharged from the innermost layers of the bed, such that the thickness of the bed remains constant. The material to be dried is discharged by means of a dosing cell roll, which is disposed in the opening between the horizontal section of the first wire loop and the horizontal section of the second wire loop.

12 Claims, 3 Drawing Sheets

METHOD AND APPARATUS FOR DRYING PARTICULATE MATERIAL

RELATED APPLICATIONS

This application is a continuation-in-part of prior application Ser. No. 07/207,865, filed June 17, 1988, now abandoned, the disclosure of which is incorporated herein by reference.

BACKGROUND AND SUMMARY OF THE INVENTION

The present invention relates to a method and apparatus for drying pulverous, granular or chip formed material such as bark, in which method and apparatus drying is effected by introducing drying gas through a bed formed of the material to be dried on an endless, moving wire.

Conventionally, drying of such materials is effected by means of a conveyor belt permeable to gas. Drying gas is blown through the conveyor belt from below and the material to be dried is fed to the front part of the belt and discharged from the rear end. Having regard to energy consumption and the drying process, such drying method is not optimal.

The object of the present invention is to provide an improved method and apparatus for drying particulate material.

The method of the present invention is mainly characterized in that a material to be dried forms a circulating bed, one side of which, i.e., where the through-flowing drying gas is discharged, is continuously supplied with material to be dried and the other side of which bed, i.e., where the drying gas is introduced, has a corresponding amount of dried material continuously discharged therefrom.

The apparatus of the present invention is characterized in that it comprises first, second, and third wire loop sections, each with a wire turning roll and a wire guide roll. The section supporting the bed of the second wire loop is disposed after the section supporting the bed of the first wire loop, in the direction of movement of the materials. There is an opening between the first and second sections supporting the bed. The wire of the third wire loop is guided via the outer wire turning roll of the second wire loop, below the first and second wire loops, further to the utmost wire turning roll of the first wire loop, and runs partly around the wire turning rolls along with the material. The material thus lies between the second and third wires and between the first and third wires. The feed means is disposed in the substantially straight, preferably horizontal, front end of the dryer section of the first wire loop, and the discharge means is arranged in the opening between the sections of the first and second wire loops, which sections support the bed.

The present invention will be further described in greater detail, with reference to the accompanying drawings, which illustrate an example of implementation of the invention.

DETAILED DESCRIPTION OF THE DRAWINGS

Figure 1:
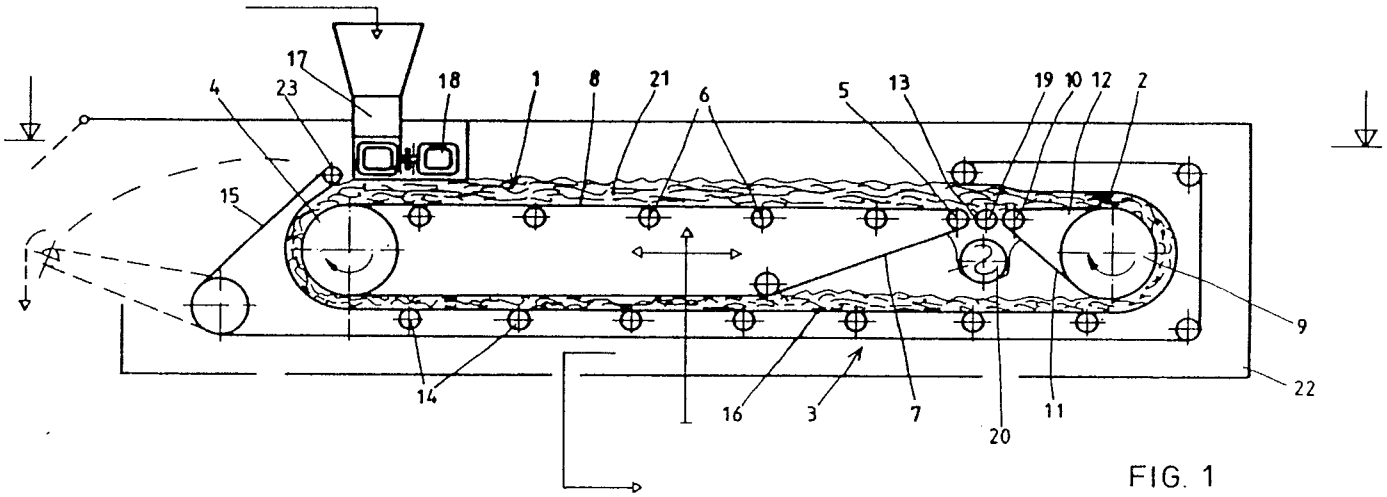
FIG. 1 is a schematic vertical cross-sectional diagram of an apparatus according to the present invention.
Figure 2:
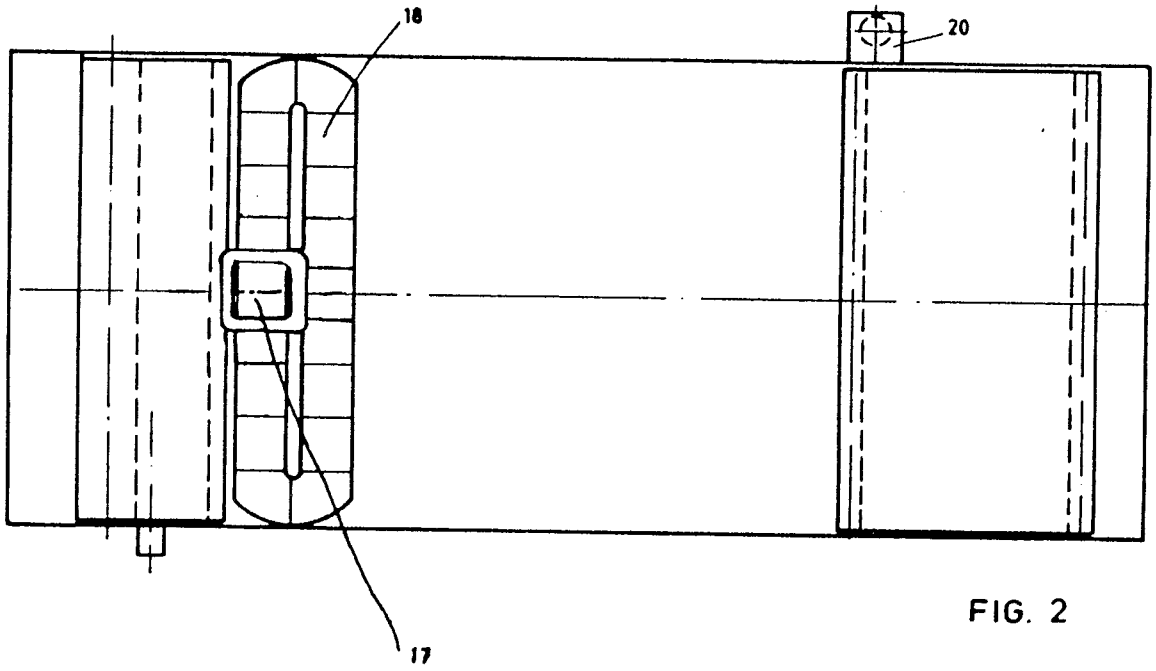
FIG. 2 is a plan view of the apparatus of FIG. 1.

A drying apparatus according to an embodiment of the present invention is shown in the drawing figures and comprises a conveyor having three endless perforated webs, i.e., wire loops, 1, 2 and 3. Inside the wire loop 1 is disposed a large wire turning roll 4, a small wire turning roll 5 and several wire guide rolls 6. A wire 7 of the wire loop 1 forms, between the wire turning rolls, a substantially horizontal section 8 supporting the material to be dried. Inside the wire loop 2, there is a large wire turning roll 9 and a small wire turning roll 10. A wire 11 of the wire loop 2 forms another, substantially horizontal section 12 between the wire turning rolls, which section supports the material to be dried. A horizontal section 12 of the wire loop 2 is disposed after the horizontal section 8 of the wire loop 1 in the direction of movement of the material so that an opening 13 is formed between the inner wire turning rolls 5 and 10 leaving the large wire turning rolls 4 and 9 at opposite ends of the conveyor. Inside the wire loop 3 is disposed a plurality of wire guide rolls 14, by means of which the wire 15 of loops is guided to run from the wire turning roll 9 to the wire turning roll 4 below the wire loops 1 and 2 so that wire 15 forms a substantially horizontal section 16 supporting the material to be dried. Wire 15 is further guided partly around the wire turning rolls 4 and 9 along with the material which in this case lies between the wires 11 and 15 and between the wires 7 and 15. A feed means 17 for feeding material to be dried continuously onto the conveyor is disposed at the front and upstream end of the horizontal section of the wire loop 1. The bed is evened and its height adjusted by means of a circulating lug conveyor 18.

Figure 3:
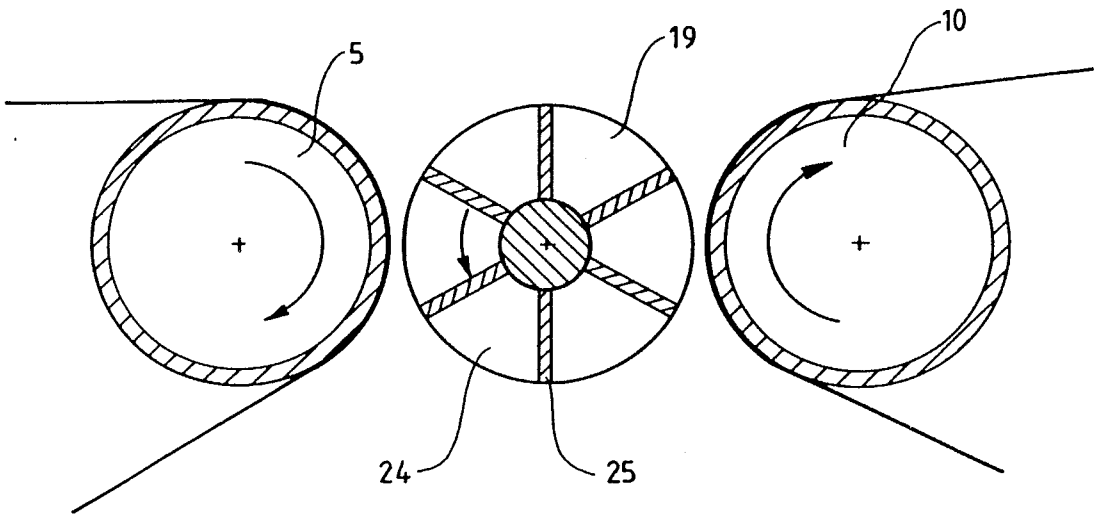
FIG. 3 is an enlarged fragmentary vertical cross-sectional view of the discharge roller between the first and second conveyor sections.

Referring to FIG. 3, a roll 19 serves as a dosing discharge means. Roll 19 is disposed crosswise to the direction of movement of the material and is arranged in the opening 13 between the wire sections 8 and 12. Below roll 19 is disposed a screw conveyor 20 for transporting dried material laterally from the conveyor.

Referring more particularly to FIG. 3, the discharge means between the wire sections 1 and 2 may comprise a discharge roll 19 mounted for rotation on a shaft and having longitudinally extending radial ribs 25 circumferentially spaced one from the other to define cells or compartments 24 in the roll 19. Roll 19 is disposed in the gap 13 between the wire sections 1 and 2 and prevents the material from falling freely through that gap between the rolls 5 and 10. Instead, roll 19 is rotatable in a reverse direction from the direction of rotation of wire turning rolls 5 and 10. Roll 19 removes in a controlled manner material from the overlying bed of material as each compartment 24 is, in turn, filled with material when the compartment faces the bed. When the roll 19 rotates, e.g., 180°, the material within the compartment 24 is emptied from the roll into the underlying screw conveyor 20 for transport laterally from the conveyor. The amount of material which can be removed can be regulated by varying the rotational speed of the roll. However, the removal of the material from the conveyor in the manner indicated below is a continuous process. It will be appreciated from the foregoing description and the following description of the operation that other equivalent structure may be provided to remove the under or lower layer of the material forming the bed on the upper conveying flights of the conveyor as the layered material passes the opening 13 en route from wire section 1 to wire section 2. For example, a doctor blade could be used in lieu of a rotating roller.

Hot and dry drying gas is introduced through the inside of wire loop 1 into a bed of material 21 forming an endless web thereof guided by the wires 1, 2 and 3 and circulating around the wire turning rolls 4 and 9. The drying gas flows through the wire 1 and the bed and further into a casing 22 of the dryer. Humid gas is handled in a manner known per se in order to remove water therefrom and to reheat it for further use.

The dried material removed by roll 19 from below the bed is discharged from the dryer by means of screw conveyor 20. Inside the undermost wire loop 3 is disposed a wire turning roll 23, which is displaceable as indicated in broken line so as to discharge the entire bed if necessary.

The discharge means 19 preferably removes the same amount of material from the circulating bed as is fed into it. Thus, the thickness of the bed remains substantially constant. The material to be dried circulates three to four turns in the dryer and about the conveyor until it is discharged. Thus, the bed is formed of several layers, the outermost of which is the most humid and the innermost of which is the driest. In this way, a long retention time in the drier is achieved for the material to be dried, the material moving in counterflow with respect to the drying gas. Because the bed moves around the wire turning rolls between the wires, the material cannot move and humid and dry material cannot mix.

In operation, material to be dried is fed into the chute 17 constituting the feed means for deposition on the wire section 1 in the form of a layer of material extending the width of the wire section 1. By initially not rotating roll 19, or covering roll 19 or lowering a doctor blade from a position in the path of the material on the bed to a position flush with the conveyor surfaces of wires 1 and 2 if roll 19 is not used, the material flows continuously from wire section 1 across gap 13 and the roll 19 or doctor blade onto wire section 2 where it is carried about the turning roll 9 by a cooperation of wire sections 2 and 3. The material advances along the inside surface of the wire section 3 where it is sandwiched between the wire section 3 and wire section 1. The material then moves about turning roll 4 for passage below the feed chute 17 where the material, being fed continuously, deposits a second layer on the first layer. The first and second layers thus are transported about the conveyor similarly as the first layer until a third layer is deposited by chute 17 and so on until the desired number of layers are deposited on the wire sections. At that time, the discharge roll 19 is uncovered and rotated in the direction indicated by the arrow in FIG. 3. The material of the first layer is deposited into the compartments 19 and, upon rotation for approximately 180°, is released to fall by gravity into discharge conveyor 20. The speed of rotation of roll 19 is such that substantially all of the first layer along the underside of the multiple layers of material forming the bed on the wire section 1 is removed. The theretofore second outermost layer of material then becomes the layer of material contiguous to wire section 2 beyond roll 19 and which layer of material is transported about the conveyor for removal in the same manner the first layer is removed. As a consequence, the material makes multiple passes about the conveyor before it is located contiguous to the wire sections for discharge by roll 19. In this manner, the driest of the material on the conveyor is removed from the conveyor while the most humid of the material constitutes the outer layer of the material carried about the conveyor. By regulating the feed rate of material through chute 17 and corresponding it to the discharge rate of material taken from the underside of the bed of material transported about the conveyor, it will be appreciated that the supply of humid material 2 and the discharge of dried material from the endless conveyor may be at the same rate with each layer making multiple turns about the conveyor between its initial deposit onto and its discharge from the conveyor.

The present invention is not limited to the embodiment described above, but it may vary within the inventive scope defined by the following claims. Thus, drying gas may flow through the material in an opposite direction, and the points of feeding and discharging may be disposed differently from what has been described above. By the term "wire" used anywhere herein, there is intended to mean any endless web of perforate or apertured material.

What is claimed is:

1. Apparatus for drying particulate material comprising:

means defining an endless conveyor for conveying material to be dried and including first, second and third conveying loops;

said first conveying loop having a pair of generally horizontally spaced first and second rolls at its opposite ends to define, in part, an upper material conveying section;

said second conveying loop having a pair of generally horizontally spaced third and fourth rolls at its opposite ends to define, in part, an upper material conveying section, said first and fourth rolls being disposed adjacent opposite ends of said endless conveyor;

the upper material conveying sections of said first and second conveying loops generally lying in a common horizontal plane and extending between opposite ends of said conveyor as defined by said first and fourth rolls;

means for guiding said third conveying loop about said first and fourth rolls and between opposite ends of said endless conveyor such that material disposed between said second and third loops is conveyed about said fourth roll from the upper conveying section of said second conveying loop onto the third conveying loop and the material disposed on said third conveying loop is conveyed about said first roll between said first and third conveying loops for disposition on the upper conveying section of said first conveying loop whereby material is conveyed endlessly along the upper sections of said first and second conveyor loops, about said fourth roll between said second and third conveyor loops and onto said third conveyor loop and between said first and third conveyor loops about said first roll onto the upper section of said first conveyor loop;

means for continuously supplying material to be dried onto said endless conveyor;

means for continuously discharging dried material from said endless conveyor;

said supplying means and said discharge means being arranged such that the material on the endless conveyor makes more than one complete loop about the endless conveyor thereby providing discrete layers of material thereon with said discharging means discharging substantially only one discrete layer at a time and which one layer has been conveyed more than one complete loop about the endless conveyor; and means providing a drying gas within said endless conveyor for flow outwardly through the material on the conveyor to dry the material.

2. Apparatus according to claim 1 wherein said discharge means includes a discharge conveyor disposed within said endless conveyor and a discharge opening between said first and second conveyor loops for discharging dried material onto said discharge conveyor.

3. Apparatus according to claim 1 wherein said supply means is disposed to discharge material to be dried onto the upper section of said first conveyor loop.

4. Apparatus according to claim 1 wherein said drying gas and the layered material move counter-currently to one another with the layer of material closest to the conveyor being discharged prior to discharging an overlying layer.

5. Apparatus according to claim 1 wherein the portion of said third conveying loop disposed about the first roll is movable between a first position for conveying particulate material with said first conveyor loop about said first roll and a second position spaced from said first roll for discharging the entire bed of material.

6. Apparatus for drying particulate material comprising:

means providing an endless conveyor for the particulate material;

means for blowing drying gas through the conveyor and through a bed of particulate material disposed on the conveyor;

means for supplying material to be dried onto the conveyor;

means for discharging dried material from the conveyor;

first, second and third endless wire conveyor loops each including a wire turning roll and a wire guide roll, said first and second loops having upper conveying sections spaced longitudinally one from the other defining a discharge opening therebetween, with said second loop disposed downstream of said first loop, said first and second loops including rolls at the opposite ends of said endless conveyor, respectively;

means for guiding said third wire loop about the end roll of each said first and second wire loops and between the opposite ends of said endless conveyor such that the third wire loop extends in part below said first and second wire loops whereby particulate material is transported between said third loop and each of said first and second loops about said end rolls, respectively, and along said third loop between said end rolls; and said supplying means and said discharging means being arranged such that the material on the endless conveyor makes more than one complete loop thereabout thereby providing discrete layers of material on said endless conveyor, said supplying means being located to supply material on top of at least one layer of material previously supplied said endless conveyor to form at least upper and lower layers of material thereon upstream of said discharging means, said discharging means discharging the lower layer of such material and leaving such upper layer of material on the endless conveyor for one more loop of conveyance thereabout.

7. Apparatus according to claim 6 wherein said endless conveyor comprises a closed loop disposed in a substantially vertical plane, and a discharge conveyor disposed within said loop for conveying dried material discharged through said opening from said endless conveyor onto said discharge conveyor for discharge in a direction laterally of said vertical plane.

8. Apparatus according to claim 6 wherein said endless conveyor comprises a closed loop disposed such that the gas is located within said loop for passage outwardly first through said conveyor and then through the bed of particulate material on said conveyor, said drying gas and the layered material moving counter-currently to one another such that the layer of material on said endless conveyor closest to the conveyor is discharged prior to discharging an overlying layer.

9. Apparatus according to claim 6 wherein the portion of said third conveying loop disposed about one of said end rolls is movable between a first position for conveying particulate material with the first or second loop associated with said one end roll about said one end roll and a second position spaced from said one end roll for discharging the entire bed of material.

10. Apparatus for drying particulate material comprising:

means defining a conveyor for endlessly conveying a bed of material to be dried along a closed path and disposed substantially in a vertical plane with upper and lower conveying sections spaced one from the other;

means defining guides at longitudinally opposite ends to define the conveyor, and, in part, said upper and lower conveying sections;

means for continuously supplying material to be dried onto said conveyor such that a plurality of successive layers of material are provided in the bed thereof on the conveyor;

means for continuously discharging dried material from said conveyor; and means providing a drying gas between said upper and lower conveyor sections for passage thereof first outwardly through said conveyor and then through the layers of material in the bed;

said supply means and said discharge means being arranged such that the material on the conveyor in each layer thereof advances a distance at least in excess of that necessary to make a complete circuit of said closed path and has a succeeding overlying layer of material thereon before being discharged from said conveyor whereby the layers of dried material are discharged from the conveyor in the order in which they are supplied to the conveyor;

said supplying means and said discharging means being arranged to supply and discharge material to and from said endless conveyor, respectively, at substantially the same rate.

11. Apparatus according to claim 10 including means for discharging the entire bed of layered material on said conveyor.

12. Apparatus according to claim 1 wherein said discharging means is located between the upper material conveying sections of said first and second conveying loops, said supplying means being located to supply material onto the upper material conveying section of said first conveying loop upstream of said discharging means and on top of at least one layer of material previously supplied said endless conveyor to form at least upper and lower layers of material on said upper material conveying section of said first conveying loop upstream of said discharging means, said discharging means discharging the lower layer of such material and leaving such upper layer on the endless conveyor for one more loop or conveyance thereabout.

* * * * *